US005421499A

United States Patent [19]

Bauer

[11] Patent Number: 5,421,499

[45] Date of Patent: Jun. 6, 1995

[54] WEARABLE TABLE

[76] Inventor: Alan C. Bauer, 1913 Maple Valley Rd., Olympia, Wash. 98502

[21] Appl. No.: 246,084

[22] Filed: May 19, 1994

[51] Int. Cl.[6] ..... A45F 5/00

[52] U.S. Cl. ..... 224/270; 224/265; 108/43

[58] Field of Search ..... 224/201, 265, 270, 907, 224/271, 42.46 B, 42.46 R, 264; 108/43, 47

[56] References Cited

U.S. PATENT DOCUMENTS

| | | | |
|---|---|---|---|
| 3,061,390 | 10/1962 | Walsh et al. | 311/17 |
| 3,541,976 | 11/1970 | Rozas | 108/43 |
| 4,715,293 | 12/1987 | Cobbs | 108/43 |
| 5,074,222 | 12/1991 | Welch | 108/43 |

*Primary Examiner*—Henry J. Recla
*Assistant Examiner*—Peter S. Hrycko
*Attorney, Agent, or Firm*—Daryl C. Josephson; Kevin A. Sembrat

[57] ABSTRACT

A portable table includes a frame that is worn by various size users while standing or sitting and can be used where free-standing tables are impractical for writing, eating and other purposes. Two hooks that telescope longitudinally from the main frame fit over the user's shoulders. A table is affixed rotatingly at a bottom side to the main frame and rotatingly and removably at a top side to a slider which is slidably affixed to the main frame. Moving the slider upward thereby rotates the table surface toward the main frame for storage while moving the slider downward rotates the table surface essentially perpendicular to the main frame for use. The slider can further be locked into place using convention means. In addition, a support bar is affixed rotatingly to the bottom of the main frame and can be rotated toward and affixed to the table in a conventional manner while the table is in use.

6 Claims, 3 Drawing Sheets

WEARABLE TABLE

BACKGROUND OF THE INVENTION

1. Field of Invention

This invention relates to a tray type device which can be worn by a person, primarily while standing, for interchangeably supporting reading and writing materials, eating materials and other typically tabletop, desktop or tray supported materials in an efficient useable position.

2. Description of Prior Art

Prior to this invention, tray type devices have primarily been directed at gathering food and beverages while in a seated position without the danger of spills and subsequent damage to a user's clothing. Most such inventions have been oriented toward a basket type device somehow suspended about the neck and often supported by the user's lap. For example, Bezdek, U.S. Pat. No. 4,985,932, discloses a Food Spill Catching and Serving Device; essentially a foldable basket for holding food while sitting in an automobile. Zemke, U.S. Pat. No. 5,056,139, discloses a Combination Food Tray and Bib which, provides a bib and lap-supported, spill catching depression. Stang, U.S. Pat. No. 5,062,558, discloses a wearable basket holder and removable basket, again for gathering food and catching spills while sitting.

In contrast, Brown et al, U.S. Pat. No. 5,094,343, discloses a combination hat, sun visor and multiple beverage can holder. While the device can be used while standing and in a hands free position, it is in essence an article of clothing with a clever built in storage rack.

One disadvantage of these devices is that their proposed purpose is limited to gathering food and beverage items, primarily in a contained form, for immanent consumption. None is designed to provide sturdy, table-like support for extended use despite eventual body repositioning. None provides a table-like tray surface for other needs, such as supporting papers while writing. Rather each provides a single purpose, bodily reinforced holder. A second disadvantage is that none, with the possible exception of Brown, is readily adaptable to, let alone designed for standing applications. In such applications a rigid, essentially flat and well supported tray of proper height and vertical orientation is crucial.

Thus there is clearly a need for a rigid, well supported and positioned tray device that can be worn and support needed materials in a useable, hands-free manner while standing.

SUMMARY OF THE INVENTION

The present invention relates to a replaceable rigid tray which can be worn by a person in a standing position and provides sufficient support while the tray is in an adjustably, essentially horizontal orientation and can be manipulated to a collapsed form for storage.

One object of the invention is to provide a wearable rigid tray that is well supported for use while in a standing position as a writing surface, food server or for other table related needs. The present invention therefore includes a shoulder hook type wearable frame with an integral tray holder, a rigid detachable tray and a lower support that engages and supports the tray from below.

A second object of the invention is to provide a wearable rigid tray that is well supported in an adjustably horizontal position while in use and can be moved to an essentially vertical position for storage. The invention therefore includes a slidable means for mounting the tray holder to the frame and a pivotable means for mounting the lower support to the frame.

A third object of the invention is to provide a wearable rigid tray that is contoured for a variety of tray related uses. Therefore the tray is replaceably affixed to the tray holder and includes an integral means for accepting the lower support.

A fourth object of the invention is to provide a wearable rigid tray that is well supported and o accommodates users of various torso sizes and physiological dimensions without discomfort. Both the support structure and the tray can therefore be positioned and oriented for safe, practical, and comfortable use.

These and other objects, advantages, features and benefits of the present invention will become apparent from the drawings and specification that follow.

DETAILED DESCRIPTION OF THE PREFERRED EMBODIMENT

Figure 1:
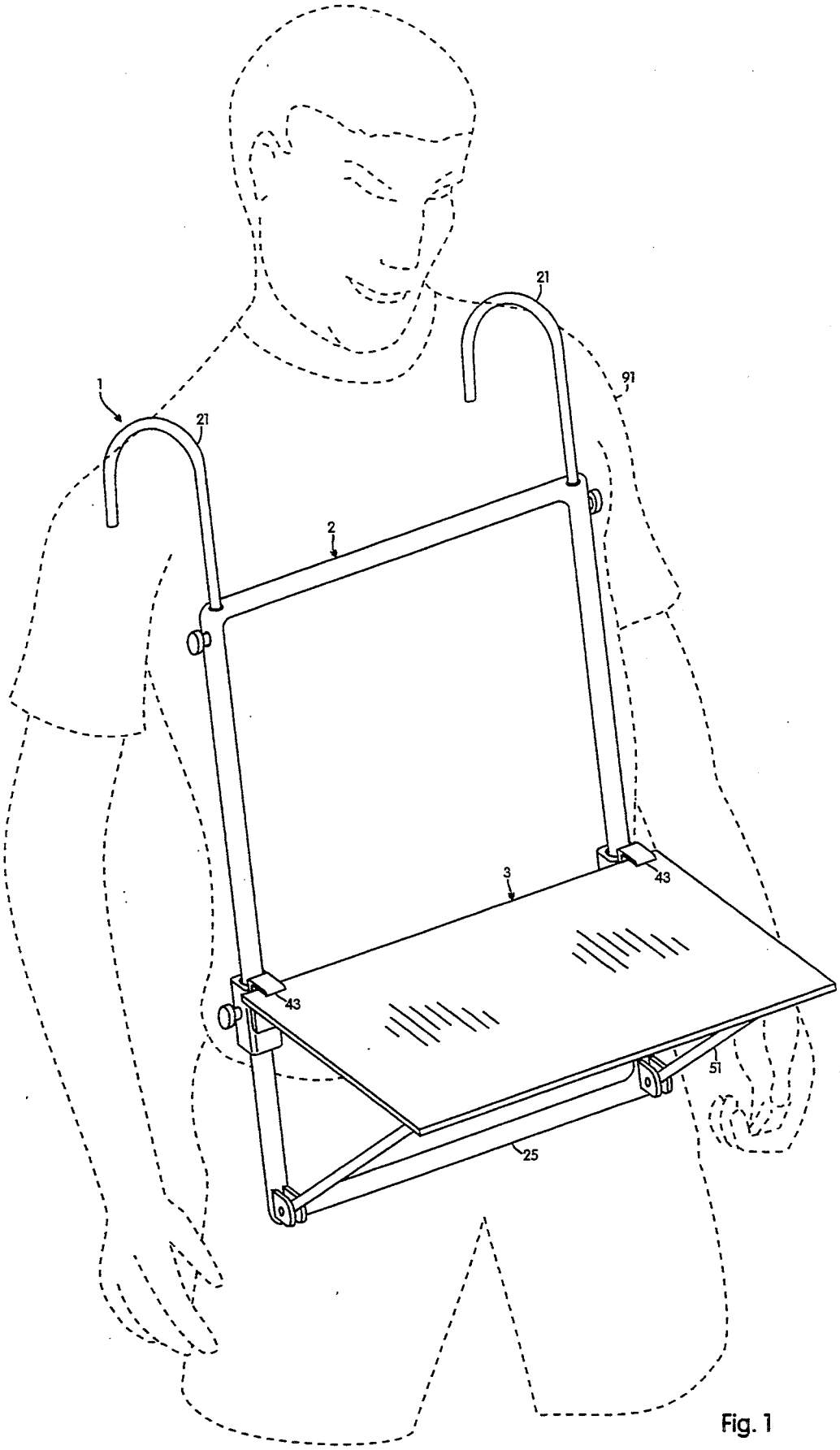
FIG. 1 is a perspective view of the preferred wearable table in a useable configuration.

Referring to the drawings, FIG. 1 shows generally how the wearable table 1 includes a frame 2 with shoulder hooks 21 that fit over the shoulders of a user 91, thereby providing vertical support of the entire assembly. Hinged tray clamps 43 are slidably affixed to the frame 21 and a "U" shaped lower support 51 pivotally engages a replaceable rigid tray 3. This arrangement forms an exceptionally strong triangular support structure for maintaining the tray 3 in an essentially horizontal position at an optimal vertical level. As detailed below, this arrangement also allows the tray 3 to be released from the lower support 51 and then moved slidably and rotatably into an essentially vertical storage position. Finally, the lower cross member 25 of the frame 2 and the lower support 51 are rounded for safety and comfort.

Figure 2:
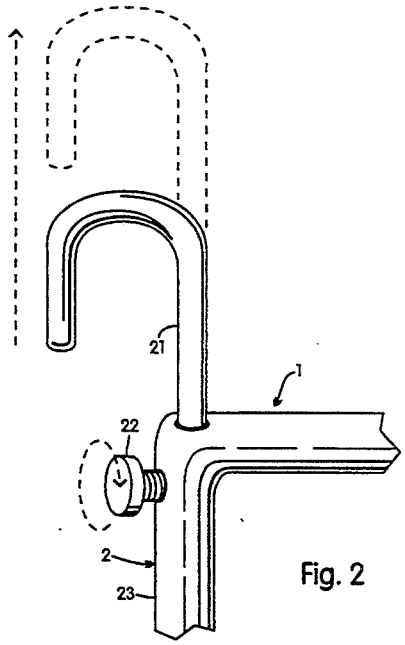
FIG. 2 is a front left partial perspective view thereof, showing operation of the telescoping shoulder hooks.

FIG. 2 shows how the shoulder hooks 21 are moved telescopingly from the tubular vertical supports 23 of the frame 2 and then locked into position using conventional screw type clamps 22. This provides for vertically compacting and expanding the elongated frame 2 for storage and for supporting a weighty anterior load in a sound, safe and comfortable position for extended periods.

Figure 3:
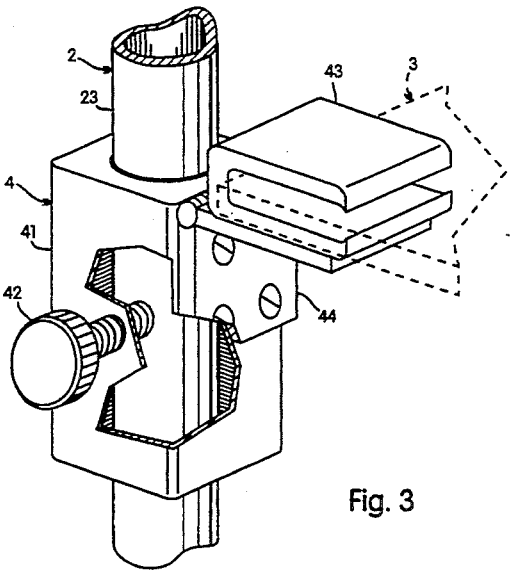
FIG. 3 is front left partial perspective view thereof, showing the operation of the moveable blocks and preferred tray receiving method.

FIG. 3 shows how a vertical block assembly 4 is used to position the frame side of the tray 3 in a proper vertical position for engaging the lower support 51 and at the same time, for useably positioning the tray 3 for specific purposes. A vertical block 41 is moved slideably along the vertical supports 23 of the frame 2 to the proper vertical position and then locked into place using conventional screw type clamps 42. The "C" clamps 43 used to secure the frame side of the tray 3 combined with the removeable lower supports 51 described above are necessary to allow interchangeability of trays such that specific trays are useable to meet specific user needs.

Figure 4:
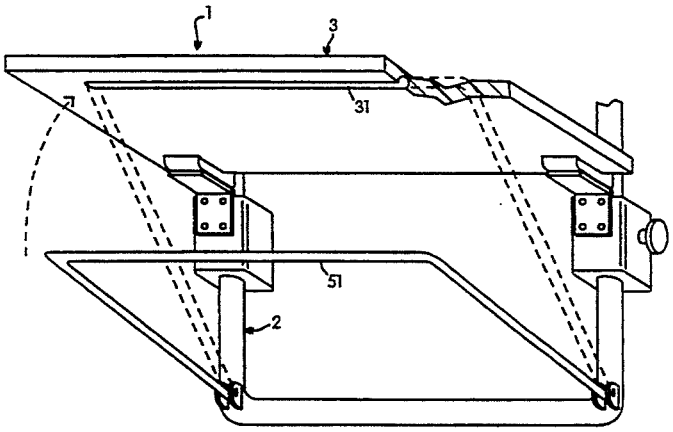
FIG. 4 is a bottom right partial perspective view thereof, showing the connection of the lower support with the tray.

FIGS. 4 shows how a "U" shaped lower support 51 pivotally affixed to the frame 2 is removably received by a flexible clamping groove 31 molded as part of the underside of the tray 3. The triangular arrangement of frame 2, tray 3 and clamped lower support 51 provides a reliable supporting means extending to nearly the outer edge of the tray 3 that is resistant to intermittent movements and jolting. This arrangement also provides for a tray surface that is wider than the frame, thereby allowing for a narrower frame 2 without decreasing the available tray 3 surface.

Figure 5A:
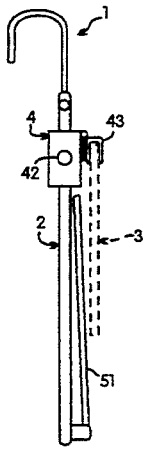
FIGS. 5*a*, 5*b* and 5*c* are left side elevation views, showing how the wearable tray is configured for use from a storage position.
Figure 5B:
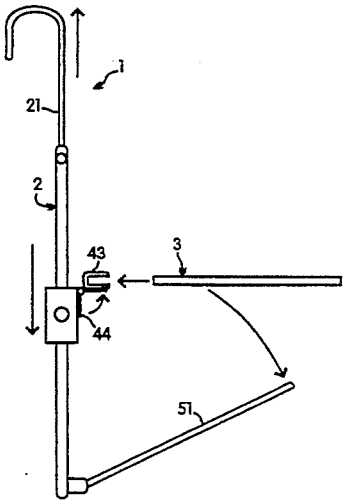
Figure 5C:
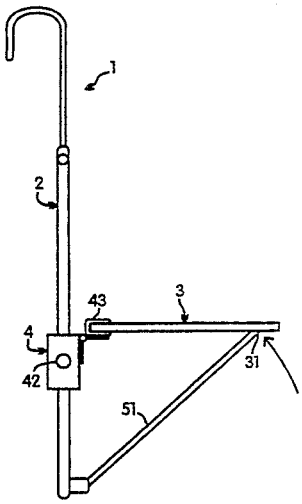

FIGS. 5*a* through 5*c* show how hinging of the C-clamps 43 provides for vertical adjustment of the frame side of the tray 3, and for compacting the wearable table 1 for storage purposes. After loosening the screw-type clamps 42 of the vertical block assembly 4, the assembly is moved slidably upward. The lower support 51 pivots at its connection to the frame 2 and rotates easily within the flexible clamping groove 31 in the underside of the tray 3. Hinges 44 provide for rotating the frame side of the tray 3 downward. When the tray 3 is thus moved to an essentially vertical position, the screw type clamps 42 are secured. Further compacting is achieved by moving the shoulder hooks 21 telescopingly into the tubular vertical supports 23 and securing them in place. The tray 3 can also be stored separately from the frame 2 by disengaging the C-clamps 43 and lower support 51, such that compacting the wearable table 1 is optional.

While the above description contains many specifities, these should not be construed as limitations on the scope of the invention, but rather as an example of the preferred embodiment thereof. Many other variations within the spirit and scope of the invention are possible.

One example is that the upper tray surface is specifically intended to be the most appropriate for the intended purpose. The flat tray surface of the preferred embodiment is simply the most generic choice in that it serves any number of varying applications reasonably well. The tray surface can also be contoured for supporting plates, dishes and utensils, cups and cans, art supplies and/or varieties of business supplies. Further, since the tray 3 is replaceably engaged with the frame, each side of the tray can be contoured for a different purpose. Reversible trays can also be used, so long as the flexible clamping groove 31 or a similar means for supporting the tray 3 is provided on both surfaces.

Figure 6:
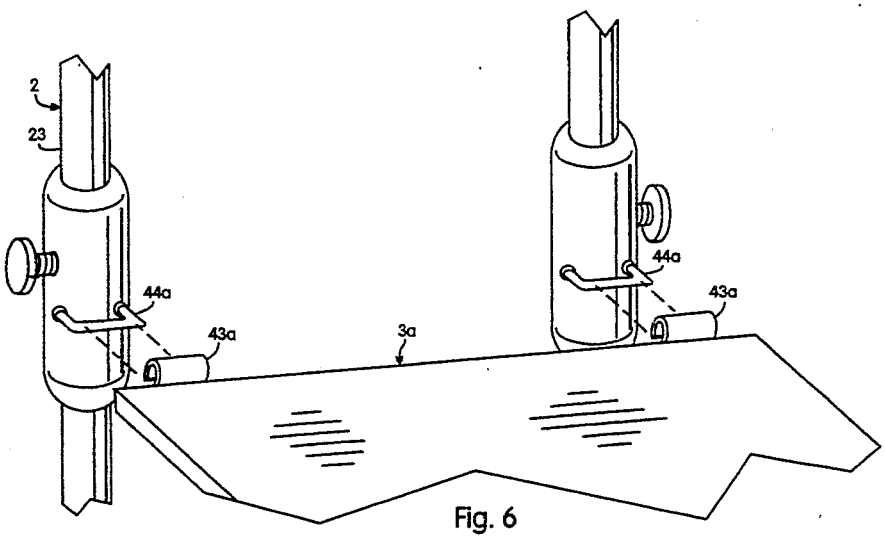
FIG. 6 is a partial perspective view showing examples sliding block and tray affixing means variations.

A second example is that specific means for collapsibly supporting the tray 3 utilizing a hinged C-clamp 43 and a molded flexible clamping groove 3 1 for receiving the U-shaped lower support 51 are not exclusive with regard to other conventional engaging means. Other means such as tubular members for receiving tray appendages, securing the frame side of the tray directly to the hinges or such designs as the rail-plus-clamp of FIG. 6 are all envisioned by the invention. A method disallowing tray disengagement can also be used. A similar observation can be made with respect to the screw type clamps of the frame 22 and vertical block assembly 42. In this case, conventional peg-and-slot or spring-loaded peg designs are seen as mere form, fit and function type, essentially equivalent replacements.

A third example is that while the addition of comfort or finishing details while not required as part of a working, cost efficient system, the addition of padding and use of tapered surfaces, is contemplated. Padding can be added to the shoulder hooks 21 and/or other parts of the frame 2 that abut the wearer. The vertical sliding block 41 does not depend upon a rectangular shape and works equally well using a rounded or tubular design (FIG. 6). The outward appearance of the frame 2 is certainly subject to various conventional shape and other finishing type details without varying in any significant utilitarian manner.

Other variations within the scope and spirit of the invention are, of course, also contemplated.

I claim:

1. A wearable table comprising:

a support frame having an upper frame end, a lower frame end, a plurality of spaced vertical support members each having an upper support end and a lower support end and a lower support end and a plurality of spaced horizontal support members each having opposite support ends connected, respectively, to the upper and lower support ends of the vertical support members, the support frame also having hook-shaped shoulder supports extending telescopingly and securingly from each upper support end of the vertical support members for suspending the frame from a wearer's shoulders;

an interchangeable rigid tray member having a frame end, a free end opposite the frame end, an upper tray surface and a lower tray surface, the tray member also having a lower support accepting means proximate to the free end of the tray member;

a lower tray support means pivotally affixed to the lower frame end of the frame and rotatingly received by the lower support accepting means for supporting the lower tray surface of the tray member while the tray member is suspended in an essentially horizontal position; and an upper tray support means slidingly and securingly affixed to the frame and releasingly affixed to the frame end of the tray member for supporting the tray member in an orientation wherein the tray extends essentially horizontally from the frame while the frame is suspended from a standing wearer's shoulders.

2. A wearable table as defined in claim 1 wherein the tray member is molded for receiving, positioning and supporting items for specific applications.

3. A wearable table as defined in claim 1 wherein the upper tray surface and lower tray surface are molded for receiving, positioning and supporting items for different applications and the frame end of the tray member is symmetrically formed whereby the tray member can be supported in a selected essentially horizontal position wherein the upper tray surface faces upward and wherein the lower tray surface faces upward.

4. A wearable table comprising:

a support frame having an upper frame end, a lower frame end, a plurality of spaced vertical support members each having an upper support end and a lower support end and a plurality of spaced horizontal support members each having opposite support ends connected, respectively to the upper and lower support ends of the vertical support members, the support frame also having hook-shaped shoulder supports extending telescopingly and securingly from each upper support end of the vertical support members for suspending the frame from a wearer's shoulders;

an interchangeable rigid tray member having a frame end, a free end opposite the frame end, an upper tray surface and a lower tray surface, the lower tray surface defining a rounded depression in the form of a flexible support accepting clamp;

a U-shaped lower tray support pivotally affixed to the lower frame end of the frame, the lower tray support having a tubular cross member that is removably and rotatingly received by the support accepting clamp of the tray member for supporting the lower surface of the tray member in an essentially horizontal position while in use; and an upper tray support slidingly and rotatingly affixed to the frame, the support having a C-shaped clamp member for securingly and interchangeably receiving the frame side of the tray member, such that the tray member can be supported in varying rotational orientations ranging from an essentially horizontal position during use and an essentially vertical position for storage.

5. A wearable table as defined in claims 4 wherein the tray member is molded for receiving, positioning and supporting items for specific applications.

6. A wearable table as defined in claim 2 wherein the upper tray surface and lower tray surface are molded for receiving, positioning and supporting items for different applications and the frame end of the tray member is symmetrically formed whereby the tray member can be supported a selected essentially horizontal position wherein the upper tray surface faces upward and wherein the lower tray surface faces upward.

* * * * *